United States Patent [19]

Hall et al.

[11] 4,004,674

[45] Jan. 25, 1977

[54] PRINTING DEVICES

[75] Inventors: Godfrey Stephen Hall, Darlington; John Harwood Leworthy, Newton Aycliffe, both of England

[73] Assignee: The General Electric Company Limited, London, England

[22] Filed: Jan. 21, 1976

[21] Appl. No.: 651,191

[30] Foreign Application Priority Data

Jan. 22, 1975 United Kingdom ..... 2763/75

[52] U.S. Cl. ..... 197/1 R; 197/148; 101/93.04

[51] Int. Cl.[2] ..... B41J 1/18

[58] Field of Search ..... 197/1 R, 133 R, 148, 197/168; 101/407 R, 407 BP, 93.04, 93.05; 235/22, 10

[56] References Cited

UNITED STATES PATENTS

| | | | |
|---|---|---|---|
| 3,417,850 | 12/1968 | Mix et al. | 197/1 R X |
| 3,583,539 | 6/1971 | Shellabarger | 197/133 R |
| 3,804,224 | 4/1974 | Barnaby et al. | 101/93.04 X |
| 3,837,461 | 9/1974 | Waibel | 197/148 X |
| 3,908,810 | 9/1975 | Denley | 197/133 R |

FOREIGN PATENTS OR APPLICATIONS

| | | |
|---|---|---|
| 1,382,638 | 2/1975 | United Kingdom |

*Primary Examiner*—Edward M. Coven
*Attorney, Agent, or Firm*—Kirschstein, Kirschstein, Ottinger & Frank

[57] ABSTRACT

The printing elements of a tape printer of the "dot matrix" type are provided by ends of a stack of metal strips which co-operate with an anvil having a rectilinear edge. The anvil is carried by a member which is pivoted on a support structure and is held in its working position by engagement with a tray carrying a spool of tape to be printed in a manner that provides a resilient mounting for the anvil. For the purpose of fitting a replacement spool of tape, the tray is movable from its working position to another position in which such fitting is more easily effected.

4 Claims, 6 Drawing Figures

PRINTING DEVICES

This invention relates to printing devices and is more particularly concerned with tape printers.

In the specification of U.S. Pat. No. 3,804,224 there is described a tape printer in which pressure-sensitive paper tape that is to be printed passes between a rigidly fixed anvil and a plurality of electro-magnetically operated printing elements. Upon operation of any one of the printing elements, a mark is printed on the paper tape due to it being squeezed between a linear edge of the anvil and a linear edge of the printing element which lies transverse to the anvil edge. A printed letter or other character is built up of a plurality of such marks by successive operations of the printing elements as the tape is advanced through the printing station.

It has now been realised that the tape printer referred to in the last paragraph is improved and is somewhat less noisy in use if the anvil, instead of being rigidly fixed, is permitted to move slightly in the direction of movement of the printing elements and act in the manner of a shock absorber.

Thus, in a tape printer which is arranged for movement of tape to be printed through a printing station at which an anvil is disposed to lie to one side of the tape and a plurality of printing elements are disposed to lie on the opposite side of the tape, the anvil and the printing elements having co-operating linear edges that lie transverse to one another and the printing elements being arranged to be selectively operated electro-magnetically for movement towards the anvil so as to enable the printer, during use, to build up a printed character by successive operations of the printing elements each of which operations causes a mark to be printed at the intersection of said linear edge of the anvil and said linear edge of the operated printing element, the improvement according to the present invention is that the anvil is resiliently mounted.

Preferably the anvil is mounted for limited movement in the direction of said movement of the printing elements and is spring-urged towards the printing elements.

Said anvil may be carried by a pivotted member which is pivotted to permit limited movement of the anvil in the direction of said movement of the printing elements and the printer may have a tray or other tape carrier which is arranged to carry a spool of tape to be printed and which is movable relative to the main structure of the printer between a normal position in which it is held captive by a releasable latch and a position in which the spool may be replaced, said tray or other tape carrier when in its normal position having limited rotational freedom about said latch and one end thereof engaging the end of the pivotted member remote from the pivot to hold the anvil adjacent to the printing elements while the other end thereof is spring-urged away from the structure so that the anvil mounting has the required resilience.

Figure 1:
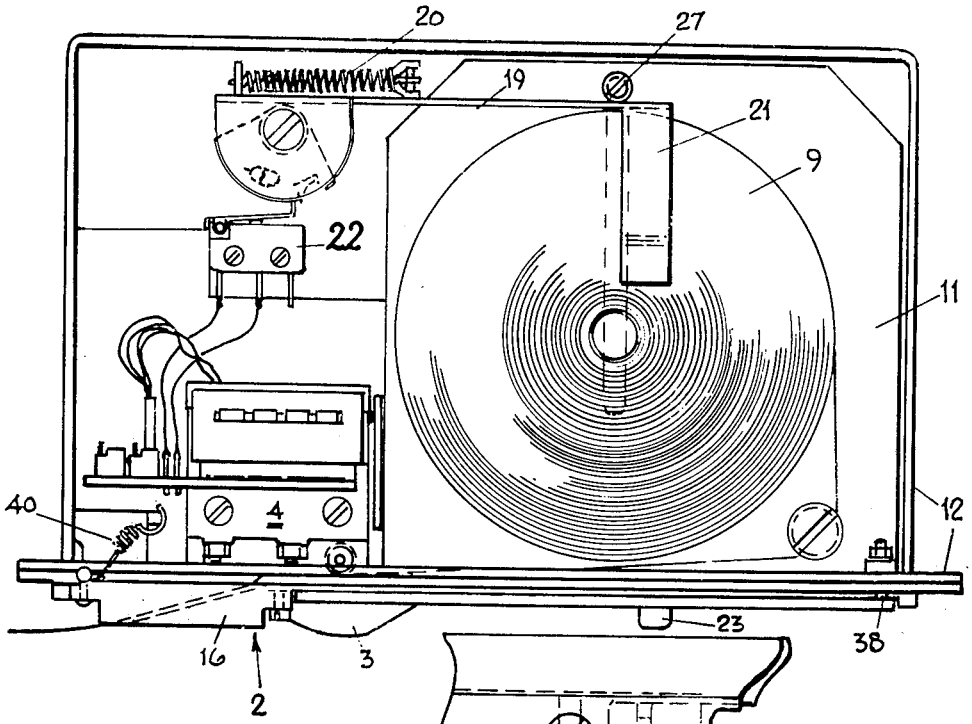
Figure 5:
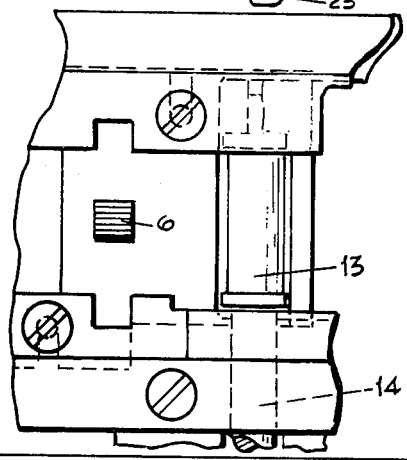
Figure 2:
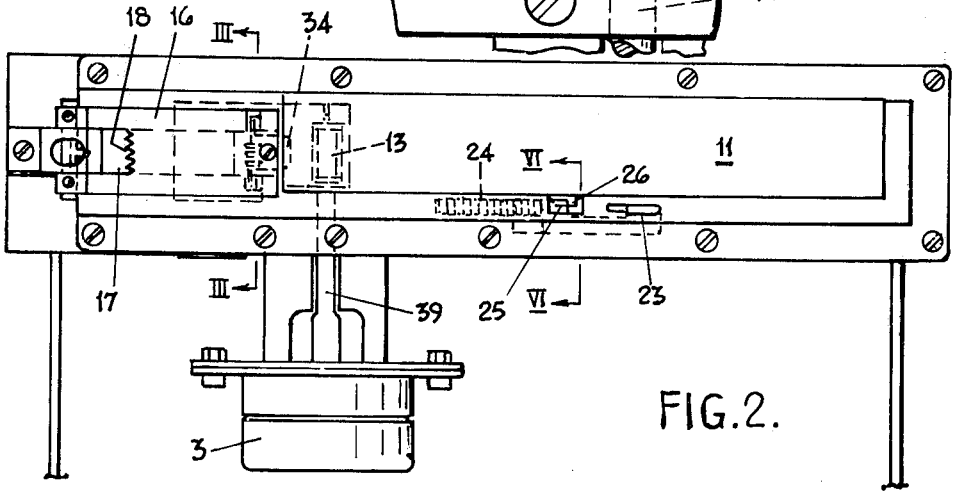
Figure 4:
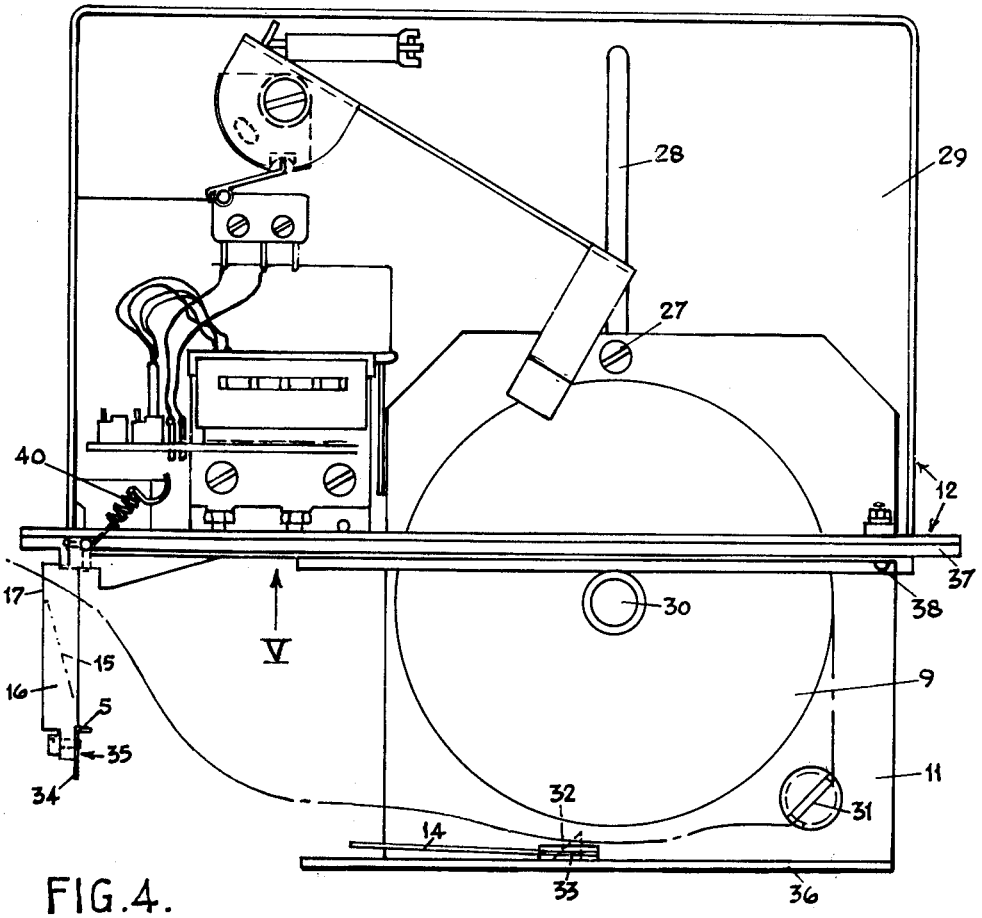
Figure 3:
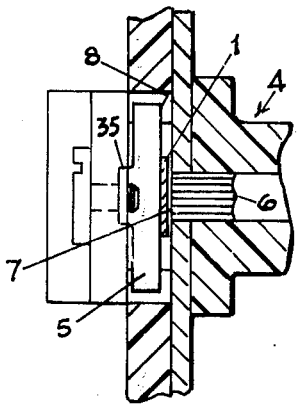
Figure 6:
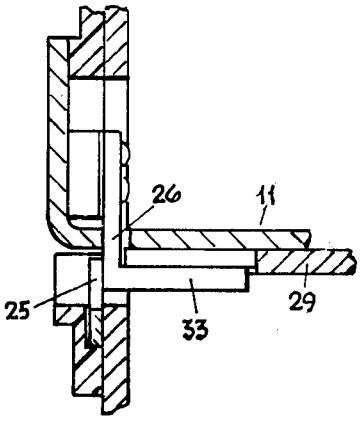

One construction of a tape printer in accordance with the invention will now be described by way of example with reference to the six figures of the accompanying drawings in which FIGS. 1 and 2 show respectively a plan view and a front elevation of the tape printer with the tape tray in its normal position for printing, FIG. 3 shows an enlarged cross-sectional view at the line III—III in FIG. 2, FIG. 4 shows a plan view of the tape printer with the tape tray in its loading position, FIG. 5 shows an enlarged view of part of the tape printer in the direction of the arrow V in FIG. 4, and FIG. 6 shows an enlarged cross-sectional view at the line VI—VI in FIG. 2.

Referring first to FIGS. 1 and 2, the tape printer now to be described is arranged to print characters on pressure sensitive paper tape 1 as that tape is advanced through a printing station 2 by means of an electric motor 3. The method of printing is essentially as described in the specification of U.K. Pat. No. 1,382,638 (corresponding to U.S. application Ser. No. 621,833, filed Oct. 14, 1975, by Bernard Sydney Barnaby, et. al., for PRINTING DEVICES) each character being formed by a selection of dots in a 5 × 7 (or 7 × 7) matrix. Thus, in the present printer and referring now also to FIG. 3 there is provided an electromagnetic printer unit 4 (as described more fully in the specification of abandoned U.S. patent application Ser. No. 497,530) and an anvil 5, a dot being printed on the tape 1 by slight movement of one of seven metal strips 6 of the printer unit 4 towards the anvil 5 under the control of an associated electromagnet (not shown) so that the tape is squeezed between the rectilinear edge 7 of the appropriate strip 6 and the rectilinear edge 8 of the anvil 5.

The paper tape 1 to be printed is drawn from a spool 9 which is carried on a tray or drawer 11 which is moveable relative to a structure 12 between the positions shown in FIGS. 1 and 4. The motor 3 and the printer unit 4 are rigidly secured to the structure 12.

Referring now also to FIG. 5, the tape 1 is pressed against a rubber roller 13 by means of a resilient member or spring 14 secured to the tray 11 (see FIG. 4). The roller 13 is connected to the electric motor 3 via a shaft 39 so that upon operation of the motor 3, the tape 1 is drawn from the spool 9 and advanced through the printing station 2. After leaving the printing station 2, the tape 1 is guided over an internal surface 15 (see FIG. 4) of a pivotted member 16 which carries the anvil 5 and the tape emerges through an opening 17.

When a length of the tape 1 has been printed, it may be readily separated from the rest of the tape with the aid of a serrated edge 18 (FIG. 2) of the member 16. (In FIG. 2 the tape 1 is not shown for clarity.)

A member 19 is urged against the outside of the spool 9 by means of a spring 20. When the spool 9 is nearly finished, the member 19 together with a member 21 to which it is secured move to a position to cause an electric micro-switch 22 to operate and thereby complete an electric circuit (not shown) which causes a visual and/or audible indication of the situation to be given.

When operationally installed, the printer described above is mounted on a housing (not shown) so that the front panel 37 of the printer lies flush with the front of the housing which thus prevents direct access to the tray 11 in its normal working position for the purpose of replacing the spool 9. To effect such replacement, a lever 23 is moved (to the left in FIGS. 1 and 2) against a spring 24 so that a latch 25 does not then engage a part 26 that is secured to the tray 11. With the latch 25 in this position, the tray 11 is withdrawn from the structure 12 as shown in FIG. 4, the tray 11 being held captive on the structure 12 by means of a screw 27 that is arranged loosely to slide in a slot 28 in the base-plate 29 of the structure 12. The member 16 is turned against a spring 40 to the position shown in FIG. 4. The spent spool 9 is then removed and a new spool fitted in its place on the peg 30, the free end of the new paper tape being threaded round a pillar 31 and through the opening 17. Finally the member 16 is returned to its normal position and the tray 11 is pushed back into the structure 12 whereupon the tape printer is again ready for use. (Referring particularly to FIGS. 4 and 6, the edge 32 of a portion 33 of the part 26 is so shaped that, as the tray 11 is returned to its normal position, the latch 25 is moved away until the tray is right home when it springs back over the part 26 to retain the tray in its normal position). At this time, the member 16 is locked in its normal working position since the end portion 34 of a metal strip 35 (the other end of which constitutes the anvil 5 as seen in FIGS. 2 and 4) is clamped behind the front panel 36 of the tray 11.

The front panel 37 of the structure 12 carries a spring-loaded stud 38 of known form, the loading spring being internal to the stud. When the tray 11 is in its normal position (as shown in FIG. 1), the end of the stud 38 presses against the panel 36 so as to tend to urge the tray away from the structure 12. The tray 11 is arranged so as to permit slight pivotal movement about the latch 25. The effect of the stud 38 pressing against one end of the panel 36 is that the other end, that is to say the end adjacent to the member 16, is pressed against the end portion 34 of the metal strip 35.

During use of the tape printer, operation of any one of the printing elements 6 exerts a force on the anvil 5. This force is applied through the end portion 34 of the strip 35 to the adjacent end of the front panel 36 of the tray 11 and the resulting turning moment about the latch 25 is somewhat greater than the restoring moment due to the spring-loaded stud 38. This arrangement ensures that the anvil 5 is resiliently mounted and is capable of slight movement (in the plane of FIG. 1) upon operation of a printing element 6.

It is to be understood that the invention is not necessarily restricted to tape printers for use with pressure-sensitive tape. If, however, non-pressure-sensitive paper is to be printed, a carbon paper tape must accompany the paper tape as it passes through the printing station of the printer.

We claim:

1. A printer for a tape which constitutes an elongated web, said printer comprising:

a. a support structure, b. tape carrier means to carry a spool of tape to be printed, c. means to mount said tape carrier means on said support structure for movement between a working position and a position which permits a replacement spool of tape to be fitted, d. releasable latch means which is carried by said support structure to retain said tape carrier means in its working position and about which there is some freedom for pivotal movement of the tape carrier means, e. means to advance tape drawn from a spool of tape carried by said tape carrier means in its working position through a printing station at which the tape is movable in a plane, f. an anvil which has a rectilinear edge, g. structural means which carries said anvil and which is pivotted to said support structure for movement between a working position in which said rectilinear edge lies adjacent to and to one side of said plane at the printing station and is retained in that position by engagement with said tape carrier means when in its working position at a point remote from said latch means and a position which facilitates threading of replacement tape through the printing station, h. an electromagnetic printer unit having a plurality of metal strips each having and end portion that constitutes a printing element, i. means to mount said printer unit on said support structure to lie on the opposite side of said plane to said anvil with the printing elements facing the rectilinear edge of the anvil when in its working position, and j. spring means which co-operates with said support structure and said tape carrier means when in its working position to apply a force to the tape carrier means at a point spaced from said latch means and on the opposite side of the latch means to that at which the tape carrier means engages said structural means carrying said anvil so that the anvil is urged towards said printing elements thereby providing a resilient mounting for the anvil which permits some movement thereof upon operation of the printing elements.

2. A printer according to claim 1 wherein said spring means is a spring-loaded stud carried by said support structure.

3. A printer according to claim 1 wherein there is means to hold said tape carrier means captive on said support structure.

4. A printer according to claim 1 wherein said tape carrier means is a tray that is slidable relative to said support structure between its working position and its tape spool replacement position.

* * * * *